United States Patent [19]

Camp

[11] 4,169,554

[45] Oct. 2, 1979

[54] SOLAR ENERGY SYSTEM WITH HEAT PUMP ASSISTANCE

[76] Inventor: Eldon D. Camp, R.R. 2, Bloomington, Ill. 61701

[21] Appl. No.: 844,032

[22] Filed: Oct. 20, 1977

[51] Int. Cl.[2] ..... F24D 11/02; F24J 3/02

[52] U.S. Cl. ..... 126/427; 126/430; 165/48 S

[58] Field of Search ..... 237/1 A, 1 R; 126/270; 165/1, 2

[56] References Cited

U.S. PATENT DOCUMENTS

| | | | |
|---|---|---|---|
| 2,575,478 | 11/1951 | Wilson | 237/1 R |
| 3,996,759 | 12/1976 | Meckler | 237/1 A |
| 4,007,776 | 2/1977 | Aikasab | 277/1 A |
| 4,049,407 | 9/1977 | Bottum | 237/1 A |
| 4,052,001 | 10/1977 | Voght | 237/1 A |

FOREIGN PATENT DOCUMENTS

| | | | |
|---|---|---|---|
| 2558791 | 7/1977 | Fed. Rep. of Germany | 237/1 A |
| 7525156 | 3/1977 | France | 237/1 A |

OTHER PUBLICATIONS

Solar Heat Pump; Popular Science; Apr. 1975; vol. 206, No. 4, pp. 106–107; Arctander.

*Primary Examiner*—James T. McCall

*Attorney, Agent, or Firm*—Clarence A. O'Brien; Harvey B. Jacobson

[57] ABSTRACT

A system for heating and cooling of environmental spaces, the present invention efficiently utilizes collected solar energy, the solar energy being stored at least partially in a phase change heat storage material. The collected solar energy can be utilized directly as an input into a heat pump evaporator, the heat pump subsystem being also utilized for direct expansion cooling. The present system particularly allows the utilization of lower temperature solar energy collection media due to the presence in the system of a heat pump, thereby resulting in greater solar collection efficiency due at least in part to lower heat conductive losses.

14 Claims, 5 Drawing Figures

10
12
14
16
18
20
22
24
26
28
30
32
34
36
38
40
42
44
46
48
50
52
54
56
58
60
62
64
68
70
72
74
76
78
80
82
90
92
94
96
98
100
102
110
112

SOLAR ENERGY SYSTEM WITH HEAT PUMP ASSISTANCE

BACKGROUND AND SUMMARY OF THE INVENTION

Solar energy collection systems previously available or proposed for use have typically included a circulating fluid which is heated by energy concentrated in one of a variety of ways onto the fluid. The heated fluid is typically either used directly to exchange heat with a second lower temperature fluid for immediate use or is stored for subsequent use as needed. Storage of heat energy of solar or other origin is therefore seen to be known in the art, phase change heat storage systems particularly providing maximum storage of both latent and sensible heat. Such heat storage systems can have heat energy withdrawn therefrom as long as the temperature of the storage medium remains at a sufficiently high level relative to ambient. It is further known to use heat pump apparatus in both heating and cooling modes to extract heat from either the atmosphere or from air present in environmental spaces, the use of such heat pump apparatus typically requiring the expenditure of significant amounts of expensive energy.

In the present invention, solar energy is utilized to provide the primary source of power for a heating system, the system being supplemented by a heat pump driven by standard sources of energy, particularly for cooling purposes. A back-up heating system of conventional design can also be employed to assure adequate heating under all conditions. Since solar energy is used as the primary source of power with only a portion of the energy required to operate the system being relatively more expensive electrical or other energy, the present system is far less costly to operate than conventional gas, oil, or electrical systems presently in use. Further, the present system provides significant advantages over prior solar energy systems due to an efficient combination of solar energy collection, storage, and utilization with heat pump assistance, the utilization of a heat pump in the present system providing a flexibility and efficiency of operation not previously to be found in the art. In particular, solar-derived energy is utilized directly in the present system as an input into the evaporator of the heat pump, thereby allowing the utilization of substantially lower temperatures in the solar energy collection medium due to the potential embodied in the present system to transfer the heat energy present in the collection medium (even at lower temperatures than is possible with prior systems) to the evaporator of the heat pump. Since the present system is thus operable during sun conditions at which other solar systems are effectively inoperable, the system is capable of functioning directly from energy as it is collected. The ability to operate at lower collection medium temperatures results in lower heat conductivity losses, thereby rendering the solar energy collection sub-system of the invention more efficient. Stored heat energy will be depleted in the present system should the withdrawal of heat energy exceed heat input from the solar energy collector. When prior art "solar heat only" systems would be shut down due to the nonavailability of useable heat reserves, the present system is capable of switching to a "water to air heat pump" mode, thereby allowing the extraction and use of the normally unuseable stored heat. In such a situation, additional heat input from the solar collector could continue to be used.

The present system further provides an energy storage sub-system having phase change energy storage capability, the phase change storage capability being particularly useful during the heat cycle of the system unlike prior systems which embody phase change storage capability. Energy storage capability is further embodied in the present system in a water storage tank, latent and sensible energy being thereby stored in both a phase change storage tank and in a water storage tank, the phase change storage tank operating within a different phase change temperature range than does the water storage tank when utilizing heats of fusion. When storage capability is exhausted, the present system provides for direct expansion operation particularly for cooling in a manner not previously available in the art.

The present system can be operated on an annual basis without the need for calculation and effective maintenance of a seasonal "balance" of heat gain and loss, the system being therefore more flexible in operation than are the relatively passive "ice" storage systems presently under study. During the heating cycle of the present system, for example, versatility is clearly shown by the potential use of several optional modes of operation, particularly the "solar only" mode, "water-to-air heat pump" mode, and "air-to-air heat pump" mode, a supplemental heating system of conventional design being capable of incorporation into the system as a back-up. The present system further provides the ability to heat domestic water even during the cooling cycle of the system.

Accordingly, it is an object of the present invention to provide a heating and cooling system capable of providing comfort climate control of environmental living spaces and other indoor areas which utilizes solar energy as the primary energy source and which incorporates a heat pump into the total system for more efficient utilization of energy collected and stored in the system.

It is a further object of the present invention to provide a solar heating system having a heat pump incorporated thereinto for utilization of energy stored in phase change storage sub-systems utilizing materials which undergo phase changes involving substantial latent heats of fusion, the latent heat of fusion and sensible heat stored in the phase change materials being utilizable in the present system to a degree not previously attainable in the art.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
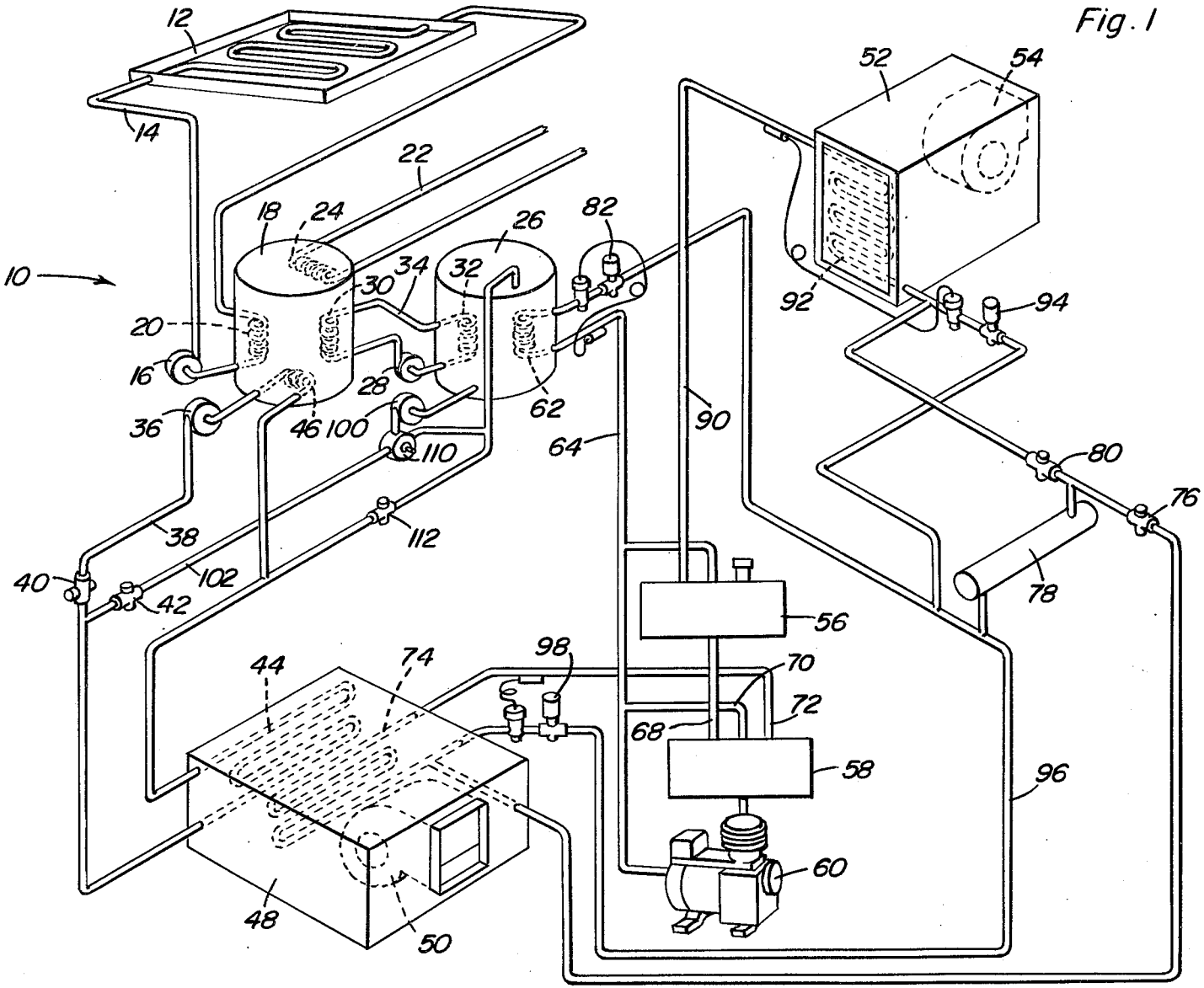
FIG. 1 is an idealized perspective view illustrating the complete system according to the invention.
Figure 2:
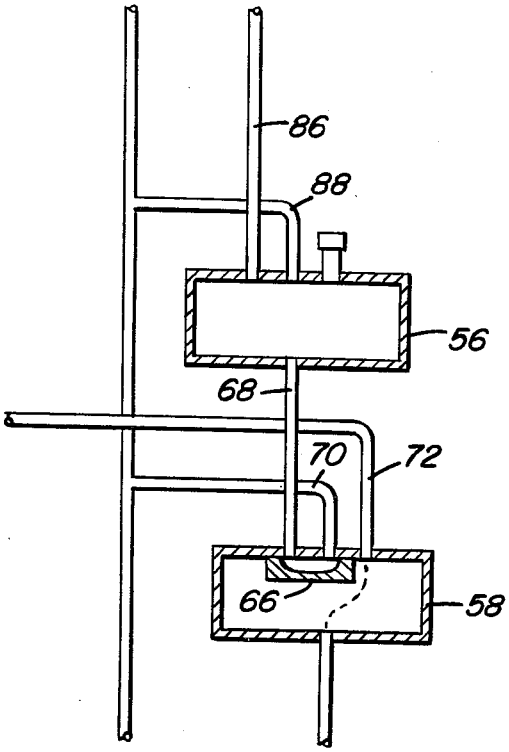
FIG. 2 is a detail idealized elevational view in section of the switch-over valve sub-system of the system of FIG. 1 in a supplemental heat cycle utilizing water-to-air heat pump assistance.

Referring now to the drawings and particularly to FIG. 1, the present system is seen at 10 to comprise at least one solar energy collector 12, a phase change storage tank 18, a storage tank 26, an indoor air distributor 48, an outdoor air distributor 52, switch-over valves 56 and 58, and a compressor 60. The system 10 is capable of operation in both heating and cooling cycles in a variety of modes, portions of the system 10 being utilizable in the several modes of operation of the system by virtue of the selective operation of the switch-over valves 56 and 58 as shown in detail in FIGS. 2–5. Although the system 10 is described herein as being preferably operated with water as a heat exchange medium, it is to be understood that other fluids are suitable for use as the heat exchange medium useful in the invention. In particular, it is well-known to use air and other fluids as the circulating medium in a solar energy collector, such as the collector 12 of FIG. 1. Further, even though the storage tank 26 is described herein as containing water as a heat exchange medium, it is to be understood that other fluids having similar properties, that is, a high seat storage capacity of at least a sensible nature, could be utilized without departing from the scope of the invention.

The system 10 of FIG. 1 collects and stores heat energy, particularly from the sun, through the operation of the solar energy collector 12. The collector 12 can take the form of a flat-plate solar collector or other solar collection apparatus of known design, a conduit 14 extending into the body of the collector 12 and preferably being formed into a sinusoidal or "tortuous" configuration to maximize heat exchange with solar energy incident on the collector 12, the conduit 14 being formed in a manner known in the art. The conduit 14 is filled with an energy collection medium which preferably comprises a fluid such as water. A pump 16 disposed in the effectively closed loop formed by the conduit 14 circulates the energy collection fluid through the conduit 14, the conduit 14 extending into the phase change storage tank 18 and being formed into a heat exchange coil 20 within the interior of the tank 18. Heat energy collected by the collector 12 and carried by means of the collection fluid through the conduit 14 and into the interior of the phase change storage tank 18 is exchanged through the coil 20 to a phase change material of conventional composition which is disposed within the tank 18. The phase change material disposed within the tank 18 preferably has a heat of fusion which is released by the material at a temperature within the operating temperature range typically encountered in the practice of comfort heating. In essence, waxes, paraffins and salts such as salt hydrates having melting points typically occuring between 100 and 140 degrees F. are employed. The phase change material absorbs heat from the collection medium through the heat exchange coil 20 as said phase change material melts. Accordingly, the phase change material stores the latent heat of fusion of the material in addition to the sensible heat absorbed by the material both prior to and subsequent to melting of said material. The heat energy absorbed by the phase change material within the phase change storage tank 18 can be withdrawn from the storage tank 18 and applied to the heating of a living space or other zone which is to be heated. Additional sensible heat is stored within the storage tank 26 by means of the transfer of heat energy through a transfer conduit 34, a transfer pump 28 pumping a fluid such as water through the conduit 34 and thus through heat exchange coils 30 and 32 disposed respectively within the storage tanks 18 and 26, the coils 30 and 32 forming portions of the substantially closed-loop conduit 34. Heat energy transferred from the phase change storage material in the storage tank 18 through the heat exchange coil 30 to the heat exchange fluid circulating within the conduit 34 is thus caused to be transferred to the energy storage medium, preferably water, located within the storage tank 26, the heat exchange fluid within the conduit 34 exchanging heat energy through the coil 32 to the energy storage medium located in the tank 26. The transfer pump 28 is to be operated during storage and heating modes. Domestic hot water can be provided by the circulation of water through a hot water conduit 22 and domestic hot water coil 24 disposed within the phase change storage tank 18, water being circulated through the hot water conduit 22 in a known fashion.

When the phase change material within the phase change storage tank 18 has absorbed sufficient energy to exist in a liquid form, that is, the phase change material has absorbed sufficient energy to have stored a given quantity of sensible heat as well as the latent heat of fusion of the material, and when the water within the storage tank 26 has been caused to store a quantity of sensible heat energy through the operation of the transfer pump 28 and transfer conduit 34, the system 10 will contain a sufficient amount of energy to provide comfort heating for a substantial period of time even without additional energy input from the solar collector 12. Continuing input or energy from the solar collector 12 enables the system 10 to function in a heating cycle using only applied solar energy as the source of heat energy for the provision of comfort heating. When comfort heating is thus demanded, a pump 36 disposed in a heating conduit 38, which heating conduit 38 contains a heat exchange coil 46 disposed within the tank 18, causes a heat exchange fluid, such as water, to be circulated within the heating conduit 38, the conduit 38 further comprising a water coil 44 disposed within the indoor air distributor 48. The water within the heating conduit 38 is thereby heated by the phase change material within the storage tank 18 through the heat exchange coil 46, the heated water being thereby circulated through the conduit 38 to the water coil 44 within the indoor air distributor 48. A blower 50 circulates air past the water coil 44, heat being exchanged from the water within the coil 44 to the air circulating about said coil, the blower 50 further acting to distribute the heated air into an area which is to be heated. A check valve 40 disposed within the heating conduit 38 is open during this mode of operation to allow circulation of water through said conduit 38, a check valve 42 disposed within a branch conduit communicating with the conduit 38 being closed during operation of the pump 36, the check valve 42 being opened during a cooling cycle operation to be described hereinafter. Operation of the pump 36 and blower 50 can be thermostatically controlled to allow the maintenance of a desired comfort level within the space or zone which is to be heated. In the heating cycle thus described, heat energy can be removed from both storage tanks 18 and 26, heat energy being removed from the storage tank 26 by the effectively reverse operation of the transfer conduit 34. If the heat output exceeds the input of energy from the collector 12 for a sufficient period of time, the phase change material within the storage tank 18 can be caused to solidify, the cooler temperatures of the water then circulating through the heating conduit 38 being then inadequate for comfort heating. Until sufficient heat energy is restored by the solar collector 12, a supplemental heat assist is utilized by heat pump operation according to the invention.

Following the extraction of heat energy from the storage tanks 18 and 26 to a degree sufficient to cause the temperatures within said tanks to fall below the temperature range needed for feasible comfort heating, useful heat energy is still available in said tanks and can be utilized by the system 10. Since the phase change material within the tank 18 can be considered to have been changed back into a solid at such a point, no significant amount of sensible heat energy is available within the storage tank 18. However, sensible and latent heat energy is available from the storage tank 26. Additionally, input from the solar collector 12 can also be utilized if solar heat is available and is being transferred to the tank 26. The heating mode to be thus described is particularly useful for ambient temperatures below 20 degrees F., the heat within the storage tank 26 not being utilizable in a direct fashion for comfort heating due to the relatively low temperature existing within the tank 26 and 18 relative to ambient. Supplemental heat can however be provided by the utilization of that portion of the system which functions as a heat pump. When supplemental heat is demanded, the pump 36 is caused to cease operation, the pump 28 continuing to operate simultaneously with operation of the compressor 60. Heat energy is thereby extracted from the water within the storage tank 26, first as sensible heat and then as latent heat as ice is caused to form within the storage tank 26 on coil 62. The coil 62 forms a portion of a thermostatically-controlled conduit 64, which conduit 64 includes the switch-over valve 58 in the mode illustrated in FIG. 2. The switch-over valve 58 is provided with a sliding port 66, seen in FIG. 2, which blocks tubes 68 and 70 in the mode described and opens tube 72, the tube 72 forming a portion of the conduit 64 to allow direct circulation between the compressor 60 and a direct expansion coil 74 disposed within the indoor air distributor 48. The conduit 64 further includes a check valve 76 and a receiver 78, the check valve 76 being open during the supplemental heat assist thus described, a check valve 80 located in a communicating conduit to be described hereinafter between the check valve 76 and the receiver 78 being closed during this sequence of operation. A refrigerant fluid within the conduit 64 absorbs heat through the coil 62 within the storage tank 26, operation of the compressor and switch-over valve 58 causing the coil 62 to function as the evaporator portion of a heat pump and the direct expansion coil 74 to function as the condenser portion of a heat pump. Heat is thus extracted from the water within the tank 26 by the fluid within the conduit 64, the heat thus carried by the fluid within the conduit 64 being exchanged to air through the direct expansion coil 74 and the heated air being thereby distributed by the blower 50 within the indoor air distributor 48 for comfort heating purposes. When heat energy is depleted from the storage tanks 18 and 26 and a demand for heat continues, automatic switching to either a water-to-air, air-to-air, or conventional heat back-up system is accomplished, a thermostatically-controlled solenoid valve 82 functioning in such a conventional switching system. Should outdoor ambient temperature be greater than 20 degrees F., then the air-to-air supplemental heating mode is selected, such mode being described hereinafter. Should outdoor ambient be below 20 degrees F., then the water-to-air mode is selected. If, after a period of operation of the water-to-air mode, a predetermined maximum of ice build-up is attained in the tank 26, then a switch to the air-to-air mode, if outdoor ambient is above 20 degrees F., or to a conventional back-up must occur. If at any time the collectors 12 input sufficient heat energy to raise the energy level in the tanks 18 and 26 to a useable level, the system reverts to the "solar only" mode.

It should be noted that any heat transferred from the solar collector 12 to the storage tank 18 during the water-to-air assist operation is also transferred within the system for heat pump assist. Should the useful heat usually stored within the tanks 18 and 26 be depleted during heat pump operation due to the unavailability of solar input, heat energy will be restored when solar energy becomes again available. Should the solar energy input buildup the heat storage capacity of the system 10 to workable levels during heat pump assist, the heat pump assist would cease operation in an automatic fashion according to thermostatic controls formed in the system.

During the water-to-air mode of operation, a pump 100 circulates water through a diverting valve 110 so that a continuous cascade of water impinges on the heat exchange elements 32 and 62. The water does not enter the conduit 38 due to the action of the valve 110 and check valve 112.

Figure 3:
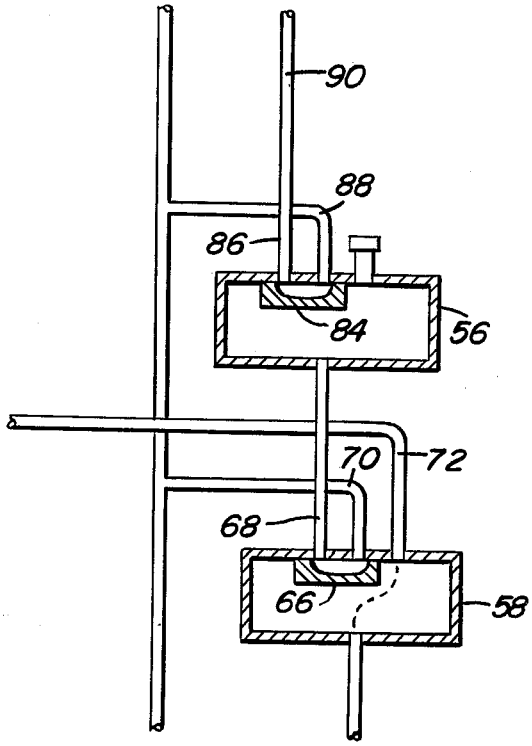
FIG. 3 is a detail idealized elevational view in section of the switch-over valve sub-system of the system of FIG. 1 in a supplemental heat cycle utilizing air-to-air heat pump assistance.

Supplementary heat assist through the operation of portions of the system 10 as an air-to-air heat pump is available as a complement to the water-to-air supplementary heat assist as previously described. The air-to-air heat assist cycle can be considered to be an alternate to the water-to-air heat pump cycle when the outdoor ambient temperature is above a predetermined level, usually 20 degrees F. Further, when all usable heat energy has been extracted from the storage tanks 18 and 26, operation of the system 10 in an air-to-air heat pump mode is necessary to provide heating function unless a conventional heating system is incorporated into the overall comfort heating system available to a user of the system. In the air-to-air heat pump assist mode, a sliding port 84 in the switch-over valve 56, as seen in FIG. 3, is seen to cause tubes 86 and 88 to form a portion of a conduit 90, the conduit 90 being closed from communication with the conduit 64 and coil 62 by the valve 82. A heat exchange coil 92 located within the outdoor air distributor 52 acts as the evaporator of a heat pump, the direct expansion coil 74 continuing to function as the condenser portion of a heat pump. Thus, heat in the ambient air is extracted by the coil 92 and fed by the compressor to the direct expansion coil 74, the heated fluid within the conduit 90 exchanging heat with indoor ambient air through the direct expansion coil 74 to provide comfort heating in a known fashion. A thermostatically-controlled solenoid valve 94 controls the flow of fluid through the conduit 90. A blower 54 within the outdoor air distributor 52 circulates outdoor ambient air over the heat exchange coil 92 to provide more efficient heat exchange operation.

Figure 4:
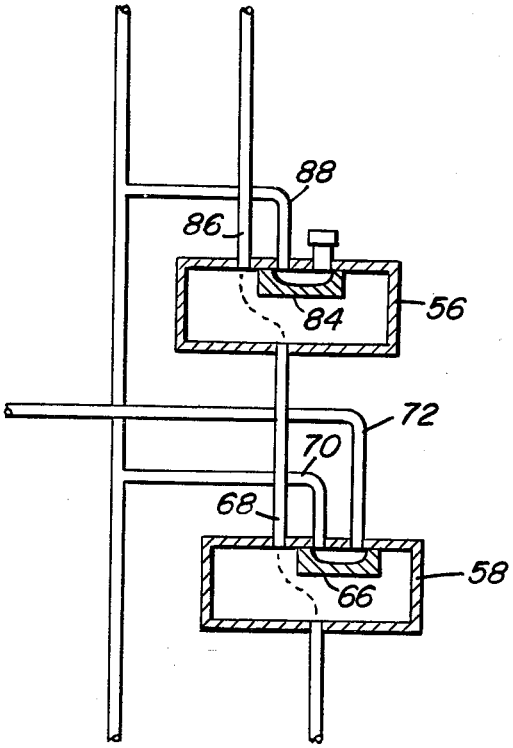
FIG. 4 is a detail idealized elevational view in section of the switch-over valve sub-system of the system of FIG. 1 in a cooling cycle utilizing air-to-air heat pump operation; and, FIG. 5 is a detail idealized elevational view in section of the switch-over valve sub-system of the system of FIG. 1 in a cooling cycle utilizing water-to-air heat pump operation.

The system 10 can be operated to provide cooling to a living zone in two operational modes, the first mode involving air-to-air heat pump operation. In the air-to-air cooling mode, a standard heat pump operating cycle is employed, this operation having the advantage of immediate cooling upon demand. Further, in the air-to-air mode, switching can instantly occur from heating to cooling operations upon demand. It is to be further noted that solar heat energy can still be stored into the storage tank 18 for domestic water heating and comfort heating as needed even during cooling operation of the system 10. The pump 28 is not operated during cooling cycles, no solar heat energy being transferred to the tank 26 during the cooling modes. The switch-over valves 56 and 58 have the sliding ports 66 and 84 positioned as indicated in FIG. 4 during the air-to-air heat pump cooling mode of operation of the system 10. In the switch-over valve 56, the sliding port 84 blocks the tube 88 and opens the tube 86 to communication with the tube 68 which connects the switch-over valves 56 and 58. The sliding port 66 of the switch-over valve 58 is positioned to cause the tubes 70 and 72 to form a portion of a conduit 96 disposed between the compressor 60 and the direct expansion coil 74, which coil 74 now acts as the evaporator of a heat pump. The heat exchange coil 92 within the outer air distributor 52 now functions as the condenser of a heat pump. Heat is thereby absorbed by the coil 74, the heat exchange fluid flowing within the conduit 96 giving off heat to outdoor ambient through the heat exchange coil 92. A thermostatically-controlled valve 98 disposed within the conduit 96 controls the flow of fluid therewithin during the air-to-air cooling mode. The check valve 80 is open in the air-to-air cooling mode, the check valve 76 being closed.

Figure 5:
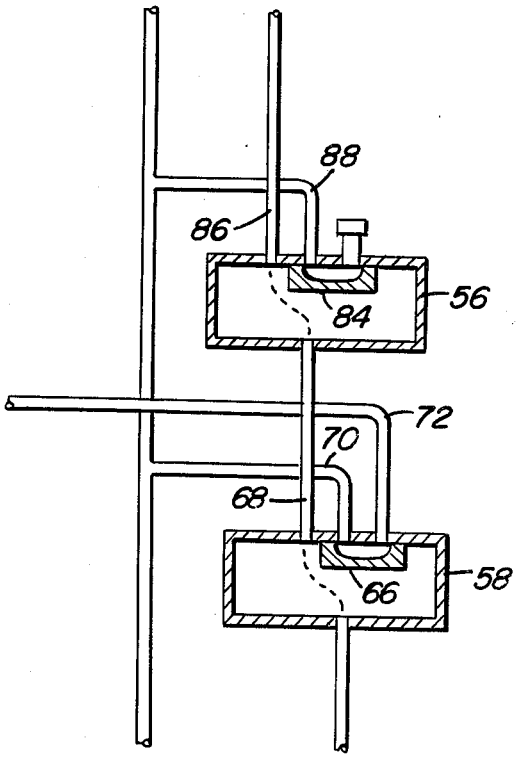

The system 10 can be operated in an alternate cooling mode through use of certain portions of the system as a water-to-air heat pump wherein chilled water within the storage tank 26 is utilized to cool an environmental living space. The switch-over valves 56 and 58 are seen to employ the arrangement of sliding ports 66 and 84 as shown in FIG. 5, the configuration of valves 56 and 58 of FIG. 5 being identical to the configuration of FIG. 4. Two modes of operation are possible here and can be selected automatically. Firstly, the air-to-air heat pump mode can be operated for cooling by direct expansion. Secondly, the air-to-water heat pump mode can be operated for ice generation by direct expansion. Priority is given to the establishment of an ice mass in the tank 26 while the pump 100 is circulating water through the diverting valve 110 in a loop fashion to and from the tank 26. No chilled water is therefor circulated through the coil 44. The "refrigeration" system is therefore only operated utilizing the chilled water during ice mass generation. When comfort cooling using the chilled water occurs, the compressor 60 does not operate. The object of such operation is to take advantage of low peak electric consumption periods to build-up an ice mass capable of providing comfort cooling during high peak periods, the compressor 60 being shut down during such high peak periods. When cooling is needed on exhaustion of the ice mass, conventional air-to-air heat pump cooling is automatically selected, the selection apparatus used in the system 10 being known in the art. The refrigeration portion of the system 10 can also be operated at night when lower ambient temperatures allow for more efficient operation and lower operating cost. Operational sequencing of the system 10 when the water-to-air heat pump cooling mode provides for ice generation when a demand for comfort cooling by direct expansion is satisfied. It is also to be seen that solar energy input into the phase change storage tank 18, without operation of the transfer conduit 34, can also occur during operation of the system in the cooling mode.

It is to be understood that the individual mechanical portions of the system 10 are known in the art, the switch-over valves 56 and 58 which employ sliding port assemblies being known in the art and thus need not be described in detail. It is further to be understood that the combination of the known mechanical portions and sub-systems of the system 10 produces advantages and results which are unexpected given the present state of the art. It is also to be understood that heat energy input into the system 10 can be effected by other than solar sources, geothermal and other sources of heat energy being useable with the invention.

The foregoing is considered as illustrative only of the principles of the invention. further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. Apparatus for controlling the thermal conditions existing in an environmental space, comprising:

fluid means for exchanging heat energy;

means for collecting heat energy, the fluid means being contained at least partially within said collecting means;

means for storing the heat energy collected by said collecting means, the fluid means at least exchanging heat energy with said storing means;

means for exchanging heat energy between the storing means and air which is to be distributed into the environmental space, the exchanging means being thermally connected to the storing means;

means for distributing the air after heat exchange contact with said exchanging means to and from the environmental space; and, heat pump means for altering the function of the apparatus to provide heating or cooling of the environmental space, said storing means comprising tank means and a phase change material disposed within the tank means, said material having a latent heat of fusion and being meltable within a temperature range near the upper temperature range of normal comfort thermal conditions within an environmental space.

2. The apparatus of claim 1 wherein the storing means further comprises second tank means and a fluid material disposed within the second tank means.

3. The apparatus of claim 2 wherein the fluid material comprises water.

4. The apparatus of claim 2 and further comprising:

heat exchange conduit means extending between and into each of the tank means;

a heat exchange fluid disposed within the conduit means; and, pump means for circulating the heat exchange fluid within the conduit means, heat energy stored in the phase change material in the first-mentioned tank means being transferred by the circulating heat exchange fluid through the heat exchange conduit means to the fluid material within the second tank means.

5. The apparatus of claim 4 wherein the exchanging means comprise:

a heat exchange conduit extending between the first-mentioned tank means and the distributing means, the heat exchange conduit having a first heat exchange portion thereof disposed within the distributing means and a second heat exchange portion disposed within the first-mentioned tank means;

a second heat exchange fluid disposed within the heat exchange conduit; and, second pump means for circulating the second heat exchange fluid through the heat exchange fluid through the heat exchange conduit, heat energy transferred to the second heat exchange fluid from the phase exchange material in the first-mentioned tank means through the second heat exchange portion of the heat exchange conduit being exchanged with relatively lower temperature air within the distributing means.

6. The apparatus of claim 5 wherein the heat pump means comprise:

a heat exchange coil disposed within the second tank means;

a direct expansion coil disposed within the distributing means;

fluid handling means connecting the heat exchange coil and the direct expansion coil for containing a third heat exchange fluid; and, compressor means for circulating the third heat exchange fluid through the fluid handling means, the fluid within the heat exchange coil absorbing heat energy through said heat exchange coil from the fluid material in the second tank means, the heat exchange coil acting as the evaporator portion of the heat pump means, the fluid within the direct expansion coil transferring heat energy through said direct expansion coil to ambient air disposed in heat exchanging relation to said direct expansion coil, the director expansion coil acting as the condenser portion of the heat pump means.

7. The apparatus of claim 6 wherein the distributing means comprises air handling means disposed in communication with the environmental space for directing air into said environmental space which has been in heat exchanging contact with the direct expansion coil.

8. The apparatus of claim 6 and further comprising:

valve means disposed in the fluid handling means for directing the third heat exchange material betwen the evaporator and condenser portions of the heat pump means.

9. The apparatus of claim 7 wherein the distributing means comprises second air handling means disposed in communication with ambient space external of the environmental space for directing ambient air to and from said second air handling means, the heat pump means further comprising:

a second heat exchange coil disposed within the second air handling means; and, second fluid handling means connecting the second heat exchange coil and the direct expansion coil located within the first-mentioned air handling means for containing the third heat exchange fluid, the compressor means circulating the third heat exchange fluid through the second fluid handling means, the second heat exchange coil acting as the evaporator portion of the heat pump means and the direct expansion coil acting as the condenser portion of the heat pump means.

10. The apparatus of claim 9 wherein the second fluid handling means comprise:

valve means for directing the third heat exchange material between the evaporator and condenser portions of the heat pump means.

11. The apparatus of claim 9 and further comprising means for converting the second heat exchange coil to function as the condenser portion of the heat pump means and for converting the direct expansion coil to function as the evaporator of the heat pump means.

12. The apparatus of claim 9 and further comprising means for converting the heat exchnge coil disposed within the second tank means to function as the evaporator portion of the heat pump means and for converting the second heat exchange coil disposed within the second air handling means to function as the condenser portion of the heat pump means.

13. The apparatus of claim 1 and further comprising means thermally communicating with the storing tank means for heating domestic water.

14. The apparatus of claim 1 wherein the collecting means comprise means for collecting solar radiation.

* * * * *